US007905527B1

(12) United States Patent
Smallin

(10) Patent No.: US 7,905,527 B1
(45) Date of Patent: Mar. 15, 2011

(54) HARNESS ASSEMBLY FOR USE IN UNDERWATER RECOVERY OPERATIONS

(75) Inventor: Bryan Smallin, Panama City Beach, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 539 days.

(21) Appl. No.: 12/079,087

(22) Filed: Feb. 11, 2008

(51) Int. Cl.
*B66C 1/00* (2006.01)

(52) U.S. Cl. ..... 294/66.1; 294/74

(58) Field of Classification Search ..... 294/66.1, 294/74; 248/320, 317; 119/769, 786, 788, 119/791; 224/579, 580, 609, 611
See application file for complete search history.

(56) References Cited

U.S. PATENT DOCUMENTS 951,684 A * 3/1910 Gillespie ..... 47/67
1,419,307 A * 6/1922 Richardson ..... 248/318
3,120,403 A * 2/1964 Molzan et al. ..... 294/74
4,002,277 A * 1/1977 Westerholm ..... 294/147
4,032,102 A * 6/1977 Wolf et al. ..... 248/318
4,592,581 A * 6/1986 Howard et al. ..... 294/2
4,736,976 A * 4/1988 Berzenye ..... 294/82.1
5,573,529 A * 11/1996 Haak et al. ..... 606/1
5,852,988 A * 12/1998 Gish ..... 119/795
5,967,481 A * 10/1999 Lobo ..... 248/323
6,626,132 B1 * 9/2003 Mann ..... 119/795

* cited by examiner

*Primary Examiner* — Saúl J Rodríguez
*Assistant Examiner* — Stephen Vu
(74) *Attorney, Agent, or Firm* — James T. Shepherd

(57) ABSTRACT

A harness assembly for use in the recovery of an object deployed underwater has legs attached to an object prior to an underwater deployment thereof. A sling is coupled to the second ends of the legs. A first support is coupled to the sling and a rigid ring. Second and third supports are coupled to the ring in a breakaway fashion and adapted to be coupled to the object. The supports work in combination to hold the ring in a stand off position with respect to the object and in a substantially vertical orientation during the underwater deployment of the object so that the ring can be readily accessed by a trained marine mammal transporting a recovery tether thereto.

18 Claims, 2 Drawing Sheets

HARNESS ASSEMBLY FOR USE IN UNDERWATER RECOVERY OPERATIONS

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to recovery of objects deployed underwater, and more particularly to a harness assembly that is attached to an object that is to be deployed underwater and then retrieved from the water by means of a tether line coupled thereto by, for example, a trained marine mammal.

BACKGROUND OF THE INVENTION

The Navy uses various objects or devices in exercise and training scenarios that must be deployed underwater. Since these devices are often expensive and can be used to collect data that must be analyzed, the devices may need to be recovered when the exercise/training sessions are complete. Currently, these devices are recovered by divers or shipboard-mounted auto-recovery systems. However, auto-recovery systems can be limited to operations at depths thought to be relevant when the auto-recovery system was designed. Reconfiguring these auto-recovery systems for operation at greater depths can be cost prohibitive. The use of divers to recover submerged devices is also limited in that the normal human-diver depth limit is about 140 feet.

The Navy is exploring other recovery options that are both cost-effective and safe for Navy personnel. One option is the use of trained marine mammals (e.g., sea lions) that can carry and couple a recovering tether to a device deployed underwater. The trained marine mammals can easily swim to depths of greater than 140 feet with a tether. However, the device to be recovered must be equipped with some type assembly to which the marine mammal can easily attach a tether. The same assembly must then be able to support the device as the tether and device are pulled up to the water's surface.

SUMMARY OF THE INVENTION

Accordingly, it is an object of the present invention to provide an assembly that can be used in the recovery of an object/device deployed underwater.

Another object of the present invention is to provide an assembly that (i) can be attached to an object/device prior to its deployment in water, (ii) will not interfere with the normal operation of the object/device so-deployed, (iii) presents an attachment point for a tether transported thereto by a marine mammal when the object/device is underwater, and (iv) can serve as a lifting harness for the object/device when the attached tether is pulled up to the water's surface.

Other objects and advantages of the present invention will become more obvious hereinafter in the specification and drawings.

In accordance with the present invention, a harness assembly for use in the recovery of an object deployed underwater has at least three legs with each leg having a first end and a second end. Each first end is adapted to be attached to an object prior to an underwater deployment thereof. A sling is coupled to the second ends of the legs. At least three supports are also provided with (i) a first support being coupled to the sling and a rigid ring, and (ii) a second support and a third support coupled to the ring in a breakaway fashion and adapted to be coupled to the object. The supports work in combination to hold the ring in a stand off position with respect to the object and in a substantially vertical orientation during the underwater deployment of the object. The harness assembly's ring can be readily accessed by a trained marine mammal that transports a recovery tether thereto.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
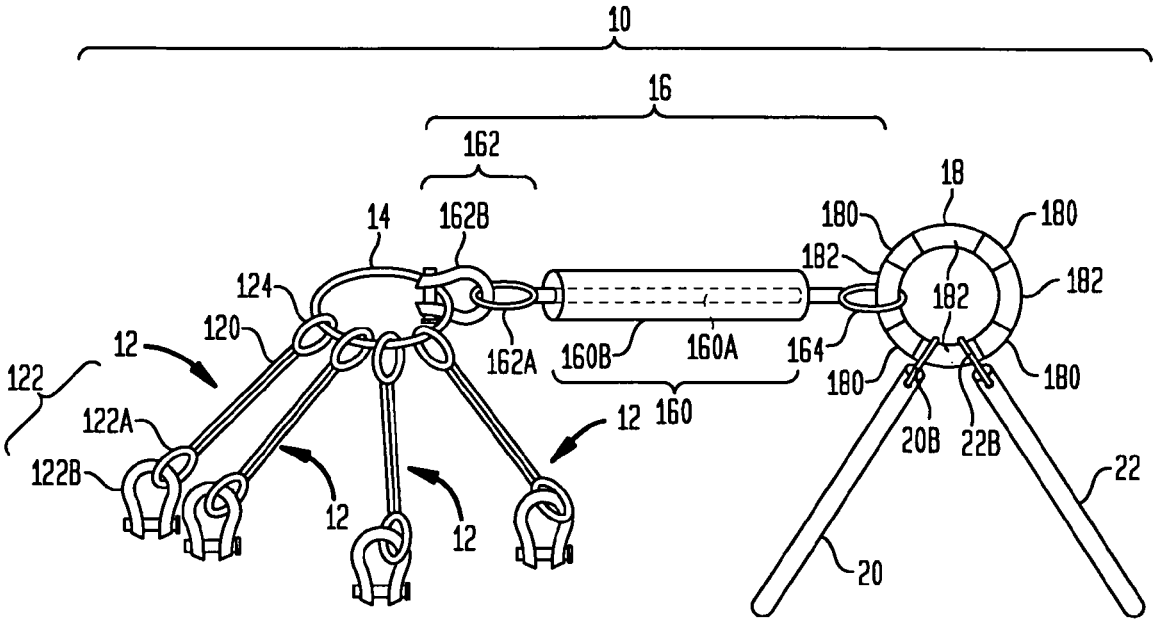
FIG. 1 is an isolated view of a harness assembly in accordance with an embodiment of the present invention for use in underwater recovery operations.

Referring now to the drawings and more particularly to FIG. 1, a harness assembly in accordance with an embodiment of the present invention is shown and is referenced generally by numeral 10. Harness assembly 10 can be coupled to many objects or devices (e.g., training or exercise mines, sensor suites, markers, etc.) that are to be deployed in an underwater environment and then retrieved therefrom by means of a tether (not shown) that will be coupled to harness assembly 10. The coupling of the tether to harness assembly 10 could be accomplished by, for example, a trained marine mammal (e.g., a sea lion).

Harness assembly 10 includes a plurality of leg assemblies 12 (e.g., at least three are required with four being shown in FIG. 1), a lifting sling 14, a lifting support assembly 16, a rigid coupling and lifting ring 18, and positioning supports 20 and 22. In general, each leg assembly 12 can be identically configured as shown with a main portion 120 terminated at one end 122 that is configured for attachment to an object or device (not shown in FIG. 1) and terminated at an opposing end 124 that is configured for attachment to lifting sling 14. For example, end 122 can have a ring 122A permanently attached to main portion 120, and a shackle 122B (or other attached clip) attachable to ring 122A and an object as will be explained further below. End 124 can be a ring (as shown) permanently attached to main portion 120 and attachable to lifting sling 14. To provide for flexibility in positioning ends 122 in a balanced or even distribution about an object, rings 124 should be permitted to slide on lifting sling 14. Each main portion 120 can be rigid or flexible, although a flexible main portion 120 (e.g., a strap) is generally preferred to facilitate attachment of harness assembly 10 on a variety of different-shaped objects. If main portion 120 is a fabric (e.g., NYLON) strap, rings 122A and 124 could be fabric loops constructed integrally with main portion 120 in ways well understood in the art.

Lifting sling 14 is any band or loop of strong (e.g., rigid) material configured to permit ends 124 to slide thereon so that leg assemblies 12 can be positioned on an object, and so that the attached end of lifting support assembly 16 can slide thereon. In the illustrated embodiment, lifting support assembly 16 has a main portion 160 terminated at one end 162 that is configured for attachment to lifting sling 14 and terminated at an opposing end 164 that is configured for attachment to coupling and lifting ring 18. Main portion 160 includes a flexible strap 160A loosely fitted in an open-ended rigid tube 160B. End 162 includes, for example, a ring 162A permanently attached to strap 160A, and a shackle 162B (or other attachable clip) attachable to ring 162A and lifting sling 14. End 164 can be a ring permanently attached to strap 160A and attached or attachable to ring 18. If flexible strap 160A is a fabric (e.g., NYLON) strap, rings 162A and 164 could be fabric loops constructed integrally with strap 160A in ways well understood in the art.

Coupling and lifting ring 18 serves as the point of attachment for a tether that will be carried to harness assembly 10 when it is underwater. To make ring 18 more visible, it can be colored/painted in two or more contrasting colors as referenced by numerals 180 and 182. For example, ring 18 could be striped as shown, i.e., colors 180 and 182 alternate on ring 18.

Positioning supports 20 and 22 are any rigid support legs that will be used in combination with lifting support assembly 16 to position lifting ring 18 in an optimum position for attachment of a tether. However, positioning supports 20 and 22 provide none of the lifting support for harness assembly 10. Accordingly, supports 20 and 22 are attached to ring 18 in a fashion that does not hinder the lifting support function of harness assembly 10 that will be explained now with reference to FIGS. 2 and 3.

Figure 2:
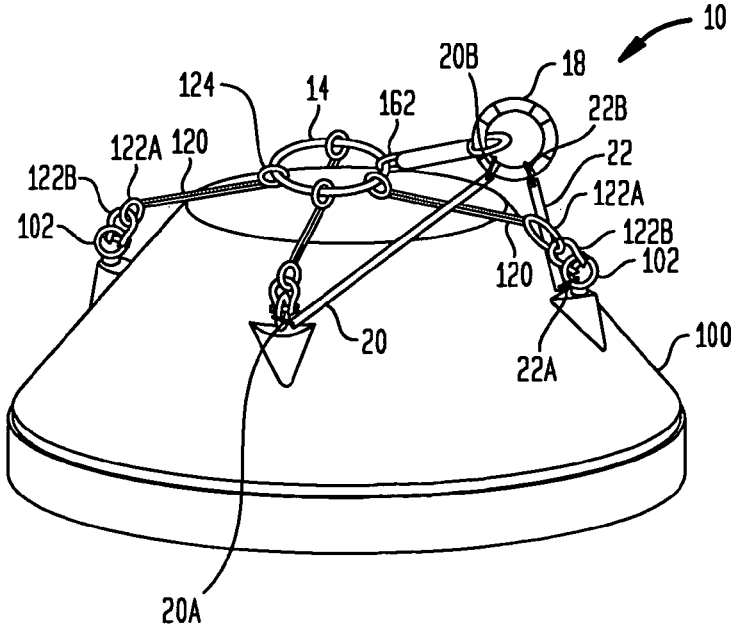
FIG. 2 is a perspective view of the harness assembly mounted on an object prior to recovery operations.

Referring first to FIG. 2, harness assembly 10 is shown attached to an object 100 that is to be deployed underwater. Specifically, shackles 122B are attached to eyes 102 provided in a distributed fashion on object 100. The flexible nature of main portions 120 allow lifting sling 14 to rest on top of object 100. Positioning supports 20 and 22 are attached to object 100 (e.g., wire tied to eyes 102 using ties 20A and 22A). Positioning supports 20 and 22 are also attached to ring 18 such that they will break away from ring 18 (FIG. 3) when object 100 is to be recovered. For example, positioning supports 20 and 22 could also be wire tied to ring 18 (e.g., using ties 20B and 22B) that will fail during a recovery. Flexible strap 160A is sized or adjusted in size to be taut when harness assembly 10 is attached to object 100 prior to its underwater deployment. In this way, the combination of lifting support assembly 16 and positioning supports 20/22 form a three-point support that can stand off ring 18 with respect to object 100 while allowing ring 18 to be placed in a substantially vertical orientation when object 100 is deployed underwater. The stand-off and vertical orientation of ring 18 combined with its contrasting-color visual appearance make ring 18 readily accessible for a trained marine mammal that is to couple a tether to ring 18.

Figure 3:
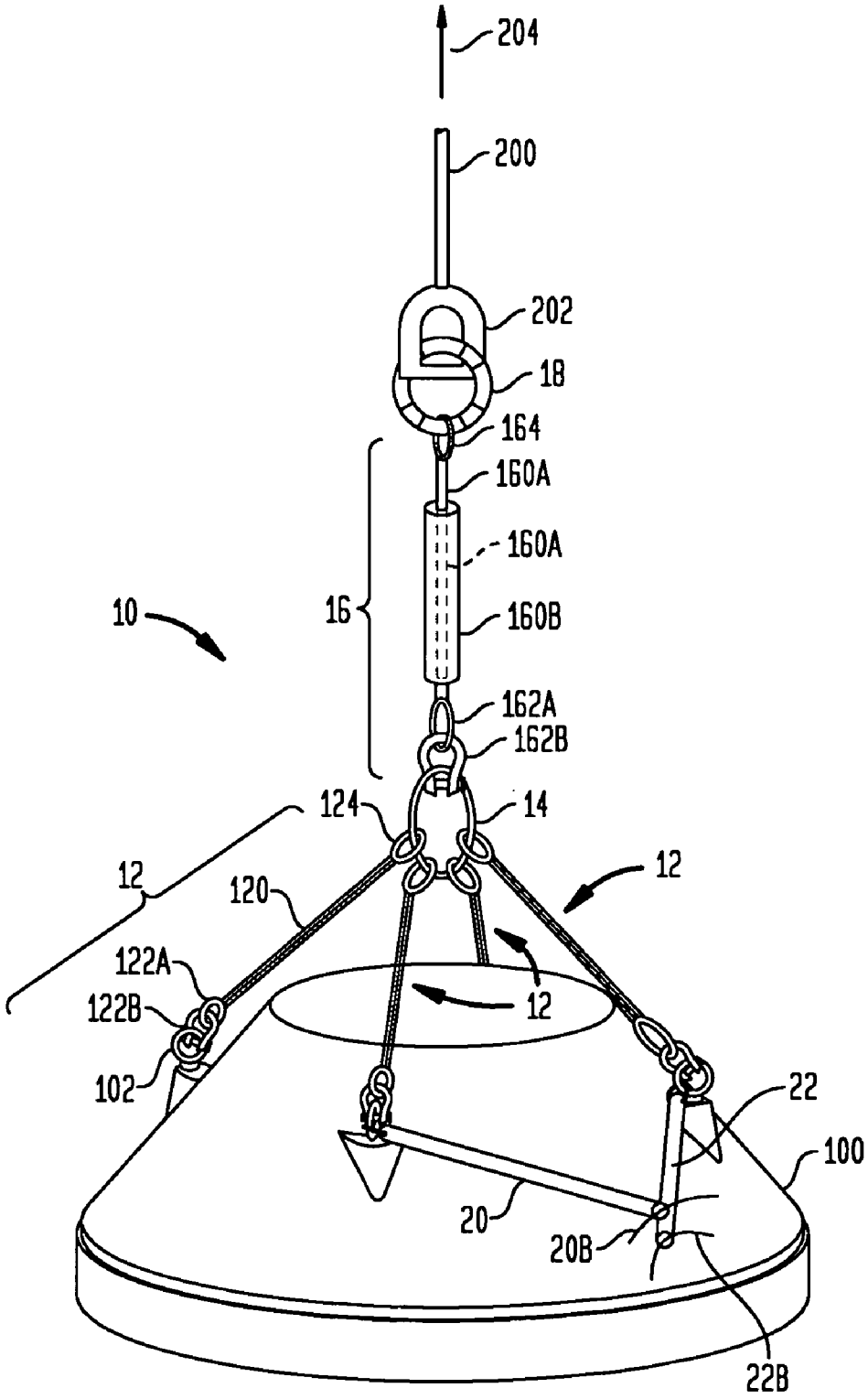
FIG. 3 is a perspective view of the harness assembly mounted on the object during a recovery operation.

Referring now to FIG. 3, harness assembly 10 is shown after a tether 200 (terminated in a snap ring 202) has been coupled to ring 18 and tension in the direction of arrow 204 is applied to tether 200. This tension causes the coupling of ring 18 to positioning supports 20/22 (e.g., wire ties 20B and 22B) to fail thereby allowing harness assembly 10 to assume its lifting position, i.e., ring 18, lifting support assembly 16 and lifting sling 14 are aligned with the tension of tether 200. In this position, lifting tension is distributed to leg assemblies 12 coupled to object 100.

The advantages of the present invention are numerous. The harness assembly is an inexpensive yet effective solution to deep water object recovery operations that must use trained marine mammals for recovery tether delivery and attachment. Also, the assembly components, including the legs, sling, ring, and support may be comprised of non-magnetic materials to avoid interference with electronic sensors or detection equipment.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. An assembly for use in the recovery of an object deployed underwater, said assembly comprising:

at least three legs, each of said legs having a first end and a second end, wherein each of said first ends adapted to be attached to an object prior to an underwater deployment thereof;

a sling coupled to said second ends of said legs;

a rigid ring; and at least three supports with (i) a first support coupled to said sling and said ring, and (ii) a second support and a third support coupled to said ring in a breakaway fashion and adapted to be coupled to the object wherein said at least three supports position said ring in a stand off position with respect to the object and in a substantially vertical orientation during the underwater deployment of the object when no lifting tension is applied to said ring, and wherein said second support and said third support separate from said ring when lifting tension is applied to said ring.

2. An assembly as in claim 1 wherein each of said legs is flexible.

3. An assembly as in claim 1 wherein said second ends of said legs and said sling are coupled together to provide for an even distribution of said first ends of said legs about the object.

4. An assembly as in claim 1 wherein said second ends of said legs are free to slide along said sling.

5. An assembly as in claim 1 wherein said first support comprises:

a flexible strap assembly coupled to each of said sling and said ring in a sliding fashion; and a rigid tube fitted over said strap assembly.

6. An assembly as in claim 1 wherein said legs, said sling, said ring and said supports comprise non-magnetic materials.

7. An assembly as in claim 1 wherein said ring has a visual appearance defined by at least two contrasting colors.

8. An assembly for use in the recovery of an object deployed underwater, said assembly comprising:

four legs with each of said legs having a first end and a second end, each of said first ends adapted to be attached to an object prior to an underwater deployment thereof;

a sling coupled to said second ends of said four legs to provide for an even distribution of said first ends of said four legs about the object;

a rigid ring; and at least three supports with (i) a first support coupled to said sling and said ring, and (ii) a second support and a third support coupled to said ring in a breakaway fashion and adapted to be coupled to the object wherein said at least three supports position said ring in a stand off position with respect to the object and in a substantially vertical orientation during the underwater deployment of the object when no lifting tension is applied to said ring, and wherein said second support and said third support separate from said ring when lifting tension is applied to said ring.

9. An assembly as in claim 8 wherein each of said four legs comprises a flexible strap with a loop formed at either end thereof.

10. An assembly as in claim 8 wherein each of said second ends of said four legs comprises coupling means for sliding freely along said sling.

11. An assembly as in claim 8 wherein said first support comprises:

a flexible support assembly coupled to each of said sling and said ring in a sliding fashion; and a rigid tube fitted over said flexible support assembly.

12. An assembly as in claim 8 wherein said four legs, said sling, said ring and said supports comprise non-magnetic materials.

13. An assembly as in claim 8 wherein said ring has a visual appearance defined by at least two contrasting colors.

14. An assembly for use in the recovery of an object deployed underwater, said assembly comprising:

at least three non-magnetic legs with each of said legs having a first end and a second end, each of said first ends adapted to be attached to an object prior to an underwater deployment thereof;

a non-magnetic sling coupled to said second ends of said legs to provide for an even distribution of said first ends of said legs about the object;

a rigid non-magnetic ring; and at least three non-magnetic supports with (i) a first support coupled to said sling and said ring, and (ii) a second support and a third support coupled to said ring in a breakaway fashion and adapted to be coupled to the object wherein said at least three supports position said ring in a stand off position with respect to the object and in a substantially vertical orientation during the underwater deployment of the object when no lifting tension is applied to said ring, and wherein said second support and said third support separate from said ring when lifting tension is applied to said ring.

15. An assembly as in claim 14 wherein each of said legs is flexible.

16. An assembly as in claim 14 wherein said second ends of said legs are free to slide along said sling.

17. An assembly as in claim 14 wherein said first support comprises:

a flexible strap assembly coupled to each of said sling and said ring in a sliding fashion; and a rigid tube fitted over said strap assembly.

18. An assembly as in claim 14 wherein said ring has a visual appearance defined by at least two contrasting colors.

* * * * *